United States Patent [19]

Hull

[11] Patent Number: 4,561,123

[45] Date of Patent: Dec. 31, 1985

[54] KNEE-PAD DEVICE

[76] Inventor: William L. Hull, P.O. Box DA, Los Gatos, Calif. 95031

[21] Appl. No.: 581,433

[22] Filed: Feb. 17, 1984

[51] Int. Cl.[4] ..... A41D 13/06

[52] U.S. Cl. ..... 2/23; 2/24; 2/16; 2/DIG. 6

[58] Field of Search ..... 2/23, 24, 16, 267, DIG. 6, 2/231

[56] References Cited

U.S. PATENT DOCUMENTS

| | | | |
|---|---|---|---|
| 1,081,245 | 12/1913 | McCall | 2/24 |
| 1,792,048 | 2/1931 | Swenson | 2/24 |
| 2,423,849 | 7/1947 | Patterson | 2/24 |
| 2,446,654 | 8/1948 | Krcmar | 2/24 |
| 2,534,888 | 12/1950 | Vold | 2/24 |
| 2,561,872 | 7/1951 | Krinick | 2/24 |
| 2,568,083 | 9/1951 | Mitchell | 2/23 X |
| 3,257,666 | 6/1966 | Hoffman | 2/267 X |
| 3,346,877 | 10/1967 | Zirves | 2/24 |
| 4,333,181 | 6/1982 | Corriero | 2/24 |

*Primary Examiner*—Werner H. Schroeder
*Assistant Examiner*—J. L. K. Olds
*Attorney, Agent, or Firm*—Paul L. Hickman

[57] ABSTRACT

A knee-pad device characterized by a flexible, arcuate pad member attached both above and below the knee. When the person using the knee pad device is standing, the pad member bows away from the knee to allow air to flow around the knee. When the person is kneeling, the pad member conforms to the shape of the knee. The pad member can be attached either to the legs of a pair of pants, or to a pair of straps which encircle a user's legs.

2 Claims, 9 Drawing Figures

KNEE-PAD DEVICE

BACKGROUND OF THE INVENTION

1. Field of the Invention

This invention relates generally to clothing accessories and more particularly to knee-pads.

2. Description of the Prior Art

Construction and maintenance workers often wear knee-pads to protect their knees and their clothing. For example, carpet installers and roofers must spend a great deal of time on their knees when practicing their trades. Without knee protection, these tradesmen become rapidly fatigued and run the risk of permanent knee injury.

The prior art discloses two major types of knee-pads. A first type of knee-pad attaches directly to the legs of a pair of pants with suitable fasteners. An example of this type of knee-pad can be found in U.S. Pat. No. 2,561,872 of Krinick which describes knee protectors including a pads attached to the legs of a pair of overalls.

A second type of knee-pad is strapped around a user's knees and thus can be used with either short or long pants. For example, U.S. Pat. No. 2,534,888 of Vold discloses a knee guard having an upper strap, a lower strap, and a knee-pad attached between the upper and lower straps.

A problem with some knee-pads of the prior art is that they tend to be uncomfortable and bulky. This is due, in part, to the inflexibility of the pads used which do not allow the pad to conform to the shape of the knee as it is bent. Furthermore, the knee-pads tend to adhere to the knee when the person is standing, causing perspiration to be trapped and preventing free air flow to the knee.

The Vold patent addresses the problem of free air flow to the knee by allowing the pad to move away from the knee when the leg is straightened. The Vold device, however, is rather elaborate construction which increases the cost and bulkiness of the unit.

The cost and bulkiness of Vold's knee-pads are not particularly improtant they are used only occasionally, but they are of critical importance to craftsmen who use their equipment daily. Furthermore, the knee-pad of Vold cannot be attached directly to a pair of pants without major modifications.

What the prior art fails to disclose, then, is an inexpensive, flexible knee-pad which can attach either directly to the legs of a pair of pants or which can be strapped around a user's knees. The prior art further does not disclose a simple, economical knee-pad which can move away from the knee when the person's leg is straightened to permit free air flow to the knee.

SUMMARY OF THE INVENTION

An object of this invention is to provide a low cost and effective knee-pad device.

Another object of this invention is to provide a knee-pad device which moves away from the knee as the leg is straightened.

Yet another object of this invention is to provide a knee-pad device which can be attached either directly to a pair of pants or to a pair of straps which can encircle a leg.

Briefly, the invention includes a substantially rectangular, flexible, arcuate pad having an upper end attached above the knee and having a lower end attached below the knee. As the knee is bent the pad flexes to conform to the shape of the knee, and as the knee is straightened the pad member bows outwardly from the knee to permit free air flow to the knee.

For the knee-pad device to operate properly, the pad member must be elongated and flexible, and attached both above and below the knee. The distance between the attachment points to the leg must be less than the length of the pad member so that it will assume its arcuate shape as the leg is straightened.

The pad can be attached directly to a leg of a pair of pants with suitable fasteners, such as VELCRO TM. Alternatively, a pair of straps can be used to attach the pad in position around the knee. The knee straps preferably include a fastener strap attached to the knee-pad member, an elastic strap having one end attached to the fastener strap, and a terminating strap attached to the other end of the elastic strap. The terminating strap is provided with a fastener such as VELCRO which can engage the fastener strap to form the knee strap into a loop. Thus, the pad member of the present invention can either be used with the strap members or can be attached directly to the legs of a pair of pants.

An advantage of this invention is that it is extremely comfortable to wear. Since the pad member bows away from a standing user's knee, perspiration is permitted to evaporate and air is permitted to flow freely around the knee.

Another advantage of this invention is that the pad member can be attached to a pair of pants or can be held to the knee with a pair of straps.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
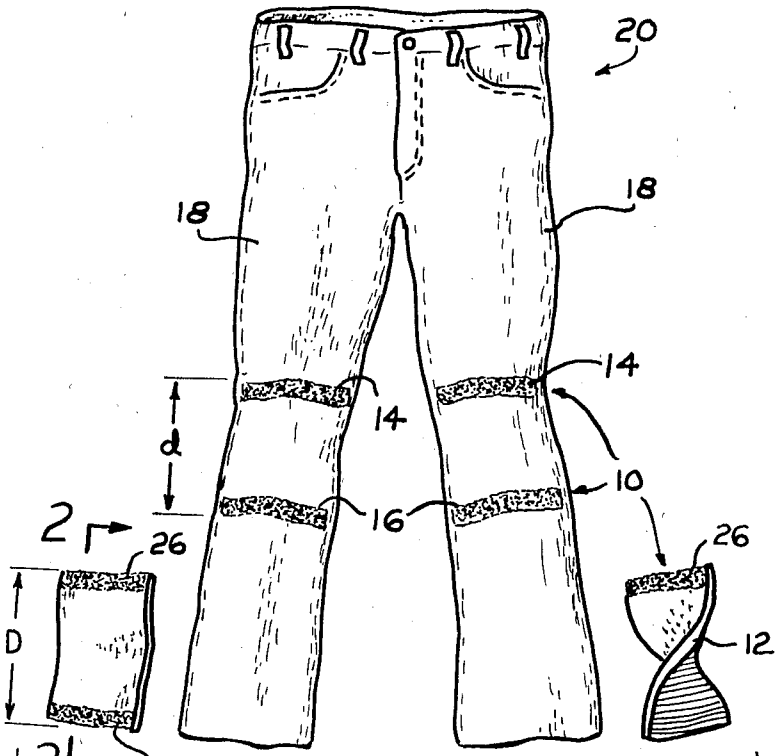
FIG. 1 is a view of pad members in accordance with the present invention and means for attaching the pad members to a pair of pants.

Referring to FIG. 1, a knee-pad device 10 includes a pad member 12, and a pair of attachment members 14 and 16 which attach the pad member 12 to a user's knee. In the embodiment shown in FIG. 1, attachment members 14 and 16 are strips of VELCRO attached to the legs 18 of a pair of pants 20.

Figure 2:
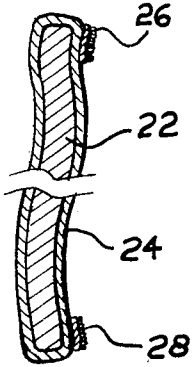
FIG. 2 is a cross sectional view taken along lines 2—2 of FIG. 1.

Referring to FIG. 2, a preferred construction for pad members 12 includes a padding 22 encased within a cover 24. Padding 22 is preferably made from a flexible, resilient material such as carpet padding, and cover 24 is preferably made from a flexible, durable material such as denim. A pair of fasteners 26 and 28 (shown here as strips of VELCRO) are attached to cover 24.

Figure 3:
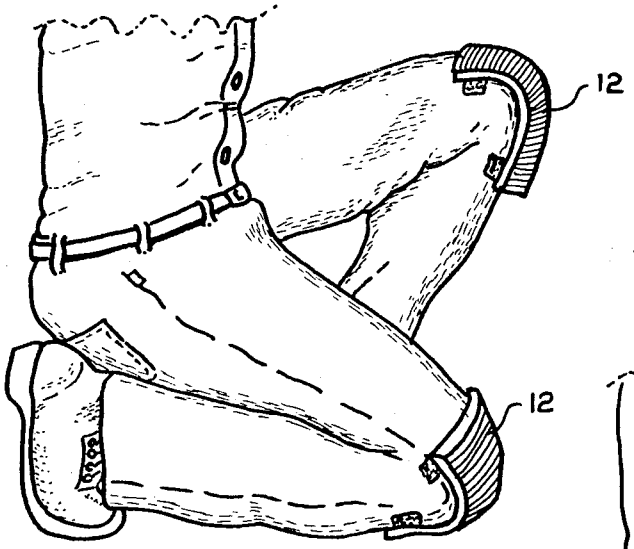
FIG. 3 is a perspective view of the pad member when the user's knee is bent.
Figure 4:
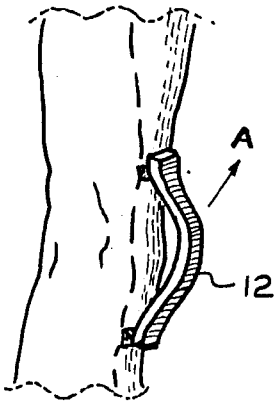
FIG. 4 is a perspective view of the pad member when the user's knee is straightened.

With reference to both FIGS. 1 and 2, fasteners 26 and 28 engage with attachment members 14 and 16, respectively. As seen in FIG. 3, when the user's knee is bent, pad member 12 bends to conform to the shape of the knee. As seen in FIG. 4, when the user's leg is straightened pad 12 assumes an arcuate shape which allows a flow of air to the user's knee, as suggested by arrow A.

It should be noted that while the pad member 12 of the preferred embodiment is substantially rectangular, other shapes can be used. It is necessary, however, that the distance D between fasteners 26 and 28 be greater than the distance d between attachment members 14 and 16 so that the pad member 12 will bow outwardly from the knee when the leg is straightened.

Figure 5:
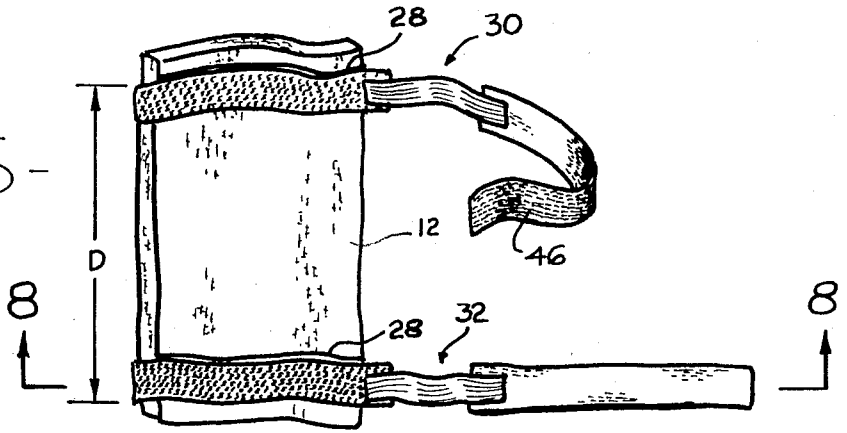
FIG. 5 is a perspective view of attachment straps which allow the pad members to be attached to a user's leg.
Figure 8:
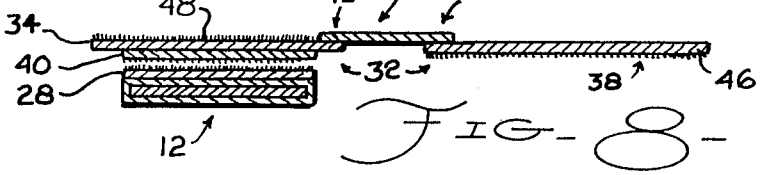
FIG. 8 is a cross-sectional view taken along line 8—8 of FIG. 5.

Referring now to FIG. 5, pad member 12 is shown attached to a pair of strap members 30 and 32. With additional reference to the cross-sectional view of FIG. 8, strap member 32 includes an attachment member 34, an elastic member 36, and a terminating member 38. Fastener strip 28 of pad member 12 attaches to a mating strip of VELCRO fastener 40. An end 42 of elastic member 36 is attached to an end of attachment member 34, and the other end 44 of elastic member 36 is attached to an end of terminating member 38. Terminating member 38 includes a VELCRO fastener 46 which can matingly engage with another VELCRO fastener 48 which is attached back-to-back with fastener 40.

Figure 7:
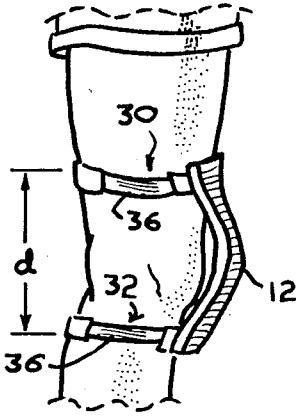
FIG. 7 is a perspective view of the knee-pad device with the user's knee straightened.
Figure 6:
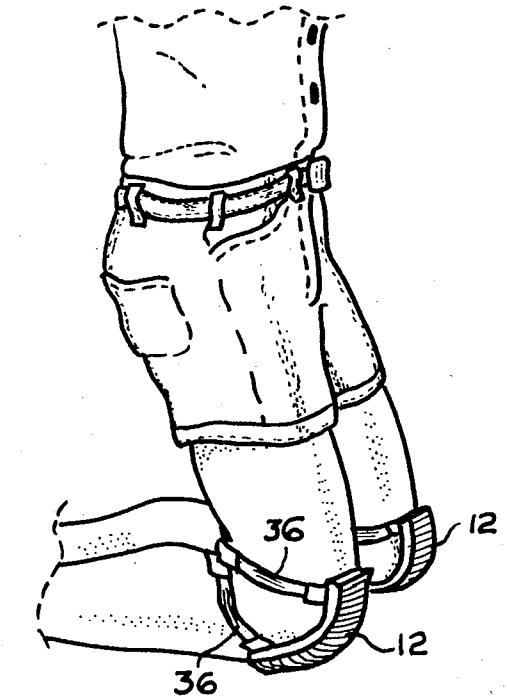
FIG. 6 is a perspective view of the knee-pad device with the user's knee bent.

Referring now to FIGS. 6 and 7, strap members 30 and 32 encircle the user's leg above and below the knee as shown. Elastic members 36 allow strap members 30 and 32 to expand as the user kneels and to contract as the user's leg straightens. Once again, the distance d between strap members 30 and 32 must be less than the distance D between fasteners 28 so that the pad member 12 will bow outwardly from a user's straightened leg as illustrated in FIG. 7.

The pad member 12 of FIGS. 5–8 is shown to be of the same construction as the pad member 12 of FIGS. 1–4. Of course, the pad member 12 can also be made of a unitary design.

Figure 9:
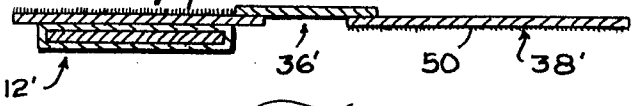
FIG. 9 is a cross sectional view of an alternate construction for the knee-pad device and attachment straps.

In FIG. 9, an alternate construction of the present invention is shown wherein a pad member 12′ is permanently attached to the attachment member 34′ of an attachment strap 32′. Attachment strap 32′ further includes an elastic member 36′ attached to attachment member 34′, and a terminating member 38′ attached to elastic member 36′. A surface 50 of terminating member 38′ can engage the surface 52 of attachment member 34′ to form attachment strap 32′ into a loop.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A pants and knee-pad combination comprising:

a pair of elongated, flexible pad assemblies, where each pad assembly has a first end, a second end, two side edges, a first fastener strip attached to an inner side surface of said pad assembly proximate said first end and extending between said two side edges, and a second fastener strip attached to said inner side surface proximate said second end and extending between said two side edges; and pants having a pair of pants legs, where each of said pants legs has a knee portion and is provided with a third fastener strip firmly attached above said knee portion which is approximately the same length as said first fastener strip, and a fourth fastener strip firmly attached below said knee portion which is approximately the same length as said second fastener strip, said third fastener strip being removably engagable with said first fastener strip and said fourth fastener strip being removably engagable with said second fastener strip, where the distance between said third fastener strip and said fourth fastener strip is substantially less than the distance between said first fastener strip and said second fastener strip, and where said distance between said third fastener strip and said fourth fastener strip is fixed due to their firm attachment to said pants leg, said first fastener strip and said third fastener strip cooperating to inhibit lateral flexure of said first end of said pad assembly, and said second fastener strip and said fourth fastener strip cooperating to inhibit lateral flexure of said second end of said pad assembly, such that said pad assembly bows outwardly at a midlength section thereof located between said first end and said second end without substantial lateral flexure when said user is in a standing position to permit free air circulation between said user's knee area and said inner side surface of said pad assembly, and wherein said pad assembly conforms to said user's knee when said user is kneeling.

2. A pants and knee-pad combination as recited in claim 1 wherein each of said pad assemblies includes a resilient, substantially rectangular pad and a cover which encloses said pad.

* * * * *